United States Patent [19]

Eisenberg

[11] 4,074,446

[45] Feb. 21, 1978

[54] SKI BOOT

[76] Inventor: Joel Howard Eisenberg, 53A Blackhawk Lane, Stratford, Conn. 06497

[21] Appl. No.: 697,437

[22] Filed: June 18, 1976

[51] Int. Cl.[2] ..... A43B 5/04; A43B 13/18; A63G 9/16

[52] U.S. Cl. ..... 36/120; 272/96; 36/28

[58] Field of Search ..... 36/117, 120, 121, 119, 36/102, 28, 114; 272/96

[56] References Cited

U.S. PATENT DOCUMENTS

| | | | |
|---|---|---|---|
| 886,801 | 5/1908 | Harmon | 36/28 |
| 1,380,879 | 6/1921 | Young | 36/28 |
| 3,067,531 | 12/1962 | Scott et al. | 36/120 |
| 3,303,584 | 2/1967 | Werner et al. | 36/120 |
| 3,775,875 | 12/1973 | Dvorsky | 36/117 |

FOREIGN PATENT DOCUMENTS

| | | | |
|---|---|---|---|
| 1,058,944 | 11/1953 | France | 272/96 |
| 103,541 | 1/1964 | Norway | 272/96 |

*Primary Examiner*—Patrick D. Lawson
*Attorney, Agent, or Firm*—Wooster, Davis & Cifelli

[57] ABSTRACT

A ski boot generally comprising an outer boot having an upper shell and a sole attached to the bottom of the upper shell. When the ski boot is in place, the outer boot is fixed to a ski. A laterally tiltable insert rests upon the portion of the sole inside the upper shell, and a foot of a skier rests upon the insert. Inversion or eversion of the skier's foot alone causes the insert to tilt thereby creating a weight shift which is transferred to the edge of the ski causing it to turn. Skiing maneuvers are, therefore, accomplished without twisting the torso or laterally moving the knees.

17 Claims, 15 Drawing Figures

Fig. 9.
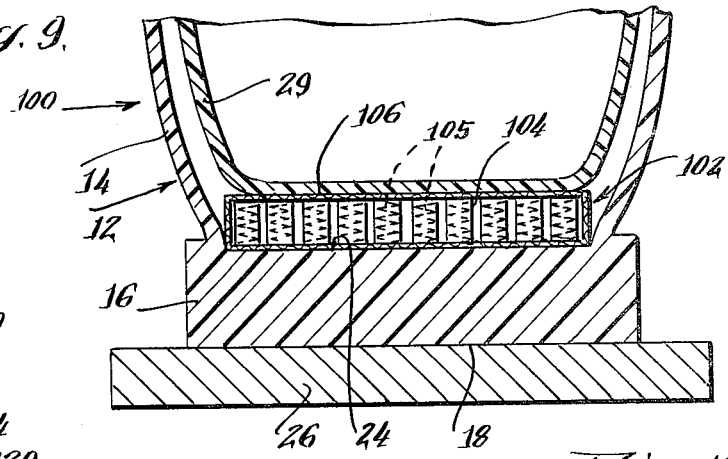
Fig. 11.
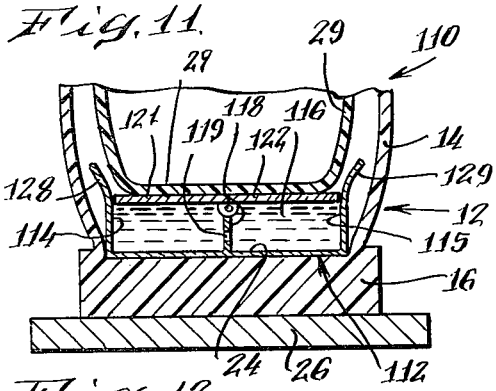
Fig. 10.
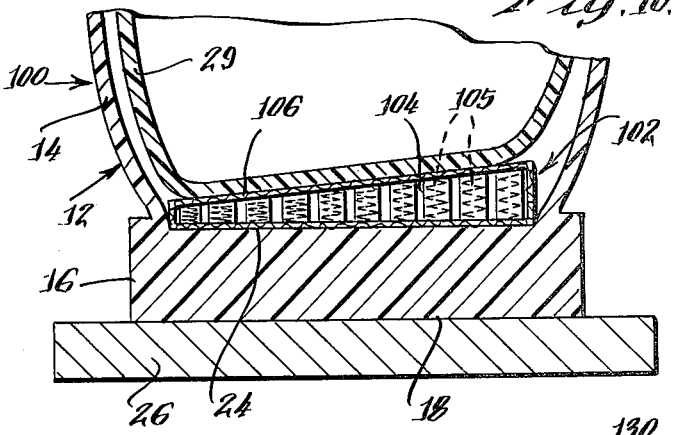
Fig. 12.
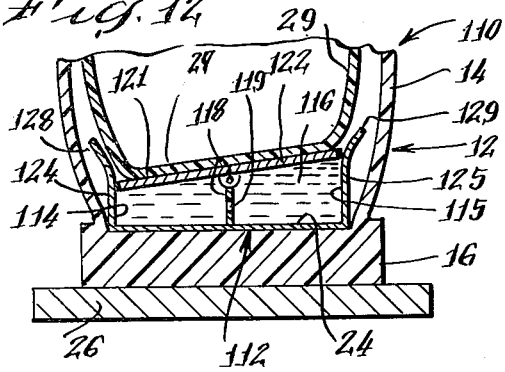
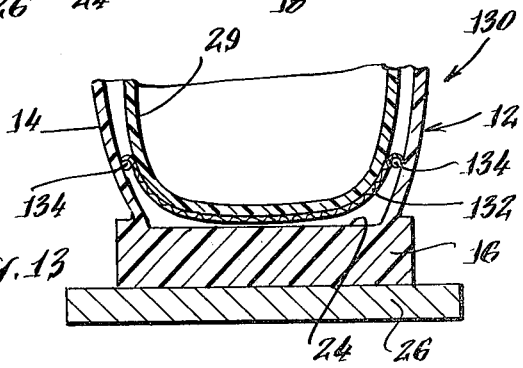
Fig. 13
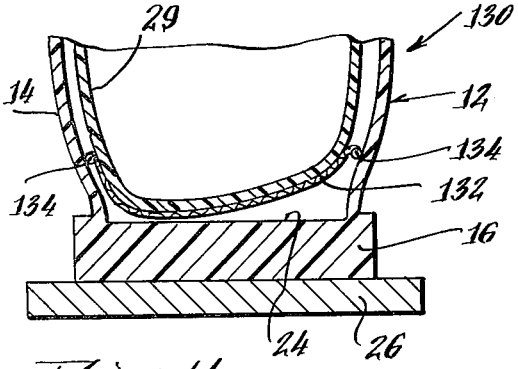
Fig. 14.
Fig. 15
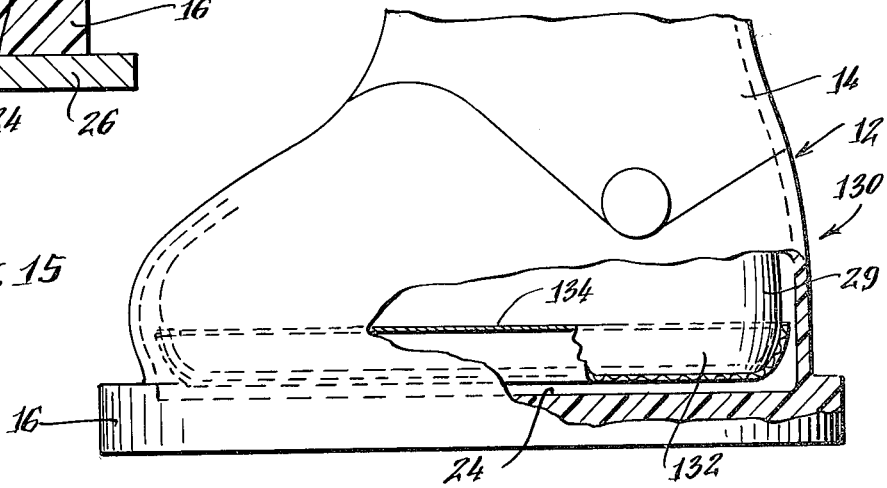

SKI BOOT

BACKGROUND OF THE INVENTION

This invention relates to an improvement in ski boots, particularly in regard to the manner in which the ski boot functions with respect to the foot and the leg of the skier in turning or maneuvering.

In skiing, the skier turns by shifting his weight so that it is temporarily transferred to either the inside or the outside edges of his skis. This causes an unbalanced effect on the skis, and they turn in the direction of the weighted edges. In short, it is this weighting and corresponding unweighting of the sides of the skis which permits the skier to maneuver as he skis down a hill.

In the prior art, the ski boot is locked to the ski by the binding and the ski boot cannot move in any direction without producing a corresponding movement in the ski. As the foot and the ankle of the skier are firmly and substantially immovably held in the prior art ski boot so that movement of the skier's foot without moving his leg is not possible, the skier turns by twisting his entire torso. The knees of the skier are laterally moved in the direction of the turn, bending his lower legs outwardly causing the boot to tilt and thereby shifting weight to the edge of the ski as required. Unfortunately, this lateral movement of the knee tends to turn the foot itself and the ski in the opposite direction against the turn. As a result, the skier expends a substantial amount of energy in turning and experiences a substantial strain particularly with respect to the knees.

Furthermore, as a result of this arrangement the prior art ski boots must be fabricated so that the sidewalls are strong enough to lock the ankle and foot in place, but at the same time flexible enough to permit the skier to bend his leg laterally in order to turn.

The prior art ski boots, therefore, do not take advantage of the foot's natural lateral tilting movement, which is known as inversion and eversion. In terms of bone structure, the foot has a subtalar joint, formed by the talus and the oscalis, which is responsible for most of the lateral movement of the foot. Because of this subtalar joint, the foot can be tilted without moving the remainder of the leg, and it is, therefore, possible to shift the weight of the body just by inverting or everting the foot without laterally moving the knees or twisting the torso. However, the subtalar motion or inversion and eversion of the foot cannot exist if the ankle and the foot are held in place as they are in prior art ski boots some of which are even form fitted to the individual's feet.

Accordingly, the prior art ski boot design is unsatisfactory from a number of standpoints, particularly since it does not permit the skier to turn easily without a great expenditure of energy and stress on various parts of the body, such as the knees and torso.

SUMMARY OF THE INVENTION

An improvement for ski boots according to the invention herein provides a means whereby the natural inversion and eversion of the foot can be employed by itself to shift the weight of a skier thereby turning the skis. The invention generally comprises a ski boot at least a portion of which is laterally tiltable with respect to the ski along the longitudinal axis by merely inverting and everting the foot. The skier can, therefore, shift his weight with relation to the edge of the skis and turn simply by a slight foot movement.

In one embodiment of the invention, a tiltable insert is used in an existing ski boot. The insert comprises a plate having a balancing point on its bottom which is inserted into a ski boot so that it balances on the inside sole of the boot. The plate is free to laterally tilt inside the ski boot which is secured to the ski in the usual manner. The foot of the skier, which is movable in the ski boot, rests upon the top of the plate. The skier can shift his weight by tilting his foot inside the boot which causes a corresponding tilt in the insert. This weight shift is transmitted to the edge of the skis while the boot and ski remain level. In this embodiment, a combination of three balance points can be used. It is also possible to use a single balancing point or a central ridge extending the entire length of the underside of the plate. A compressible material can be used to fill the bottom of the boot around the insert and provide a means by which the insert is aided in returning to its level position after the weight distribution has returned to normal. This particular embodiment need not be employed inside the ski boot, but may be adapted so as to constitute the actual sole of the ski boot itself.

In another embodiment of this invention, the sole of the ski boot is a movable plate which is longitudinally pivoted. This pivot plate is attached inside the boot at the toe and at the heel so that in a level position the plate is somewhat above the ski. The foot rests upon the plate and upon inversion or eversion, the plate will tilt with respect to the ski boot and the ski causing the requisite weight shift to be transmitted to the edge of the ski.

In another embodiment of the invention, the insert is comprised of a series of compressible sections. This insert is placed inside an existing ski boot so that pressure on one side of the insert from a weight shift will collapse that particular side alone, and thereby transmit the weight shift to the edge of the ski.

In another embodiment, the insert comprises a fluid duct system which consists of two compartments longitudinally arranged in the boot and separated by a divider wall. The divider wall has a few ducts so that fluid can pass between compartments. Each compartment is covered by a movable top hinged at the upper edge of the divider wall. When pressure is put on one of the movable tops, it is depressed into its compartment thereby forcing the fluid out and into the opposite one. This raises the top on the other side and enhances the tilting effect.

In another embodiment of the invention, a sling is supported inside an existing ski boot so that in its normal position, the skier's foot rests in the sling and does not contact the sole of the boot. Upon inversion or eversion of the foot, the foot will slide with respect to the sling. If the sling is resilient, it stretches in the direction of the weight shift and when fully tilted, the edge of the foot may contact the sole of the boot.

The invention described herein can be incorporated into a specially designed boot or added as an addition to an already existing ski boot. The tilting of the foot itself with this invention will cause a corresponding weight shift to the edge of the ski resulting in the skis turning without the need for corresponding twisting, straining and lateral movement of the knees and torso of the skier.

Accordingly, a principal object of the present invention is to provide a ski boot which facilitates turning and maneuvering.

Another object of the present invention is to provide a ski boot whereby the weight shift to the edge of the skis is accomplished by movement of the foot instead of substantial lateral movement of the knees and twisting of the torso.

Another object of the present invention is to provide an insert which can be easily adapted to existing ski boots.

Other and more specific objects of the invention will be in part obvious and will in part appear from the following description of the preferred embodiments and claims taken together with the drawings.

BRIEF DESCRIPTION OF THE DRAWINGS

FIG. 9 is a cross-sectional rear view of another ski boot according to the invention herein;

FIG. 10 is a cross-sectional rear view of the ski boot of FIG. 9 with a portion of the insert compressed and tilted;

FIG. 11 is a cross-sectional rear view of another ski boot according to the invention herein;

FIG. 12 is a cross-sectional rear view of the ski boot of FIG. 11 with the insert tilted;

FIG. 13 is a cross-sectional rear view of another ski boot according to the invention herein;

FIG. 14 is a cross-sectional rear view of the ski boot of FIG. 13 with the insert tilted; and FIG. 15 is a side view of the ski boot of FIG. 13 with a portion cut away.

The same reference numbers refer to the same elements throughout the various Figures.

DESCRIPTION OF THE PREFERRED EMBODIMENTS

Referring now to FIGS. 1–6, a first embodiment 10 of a ski boot according to the invention is shown herein. The ski boot 10 generally comprises two main elements which are an outer boot 12 and a movable insert 30.

Figure 1:
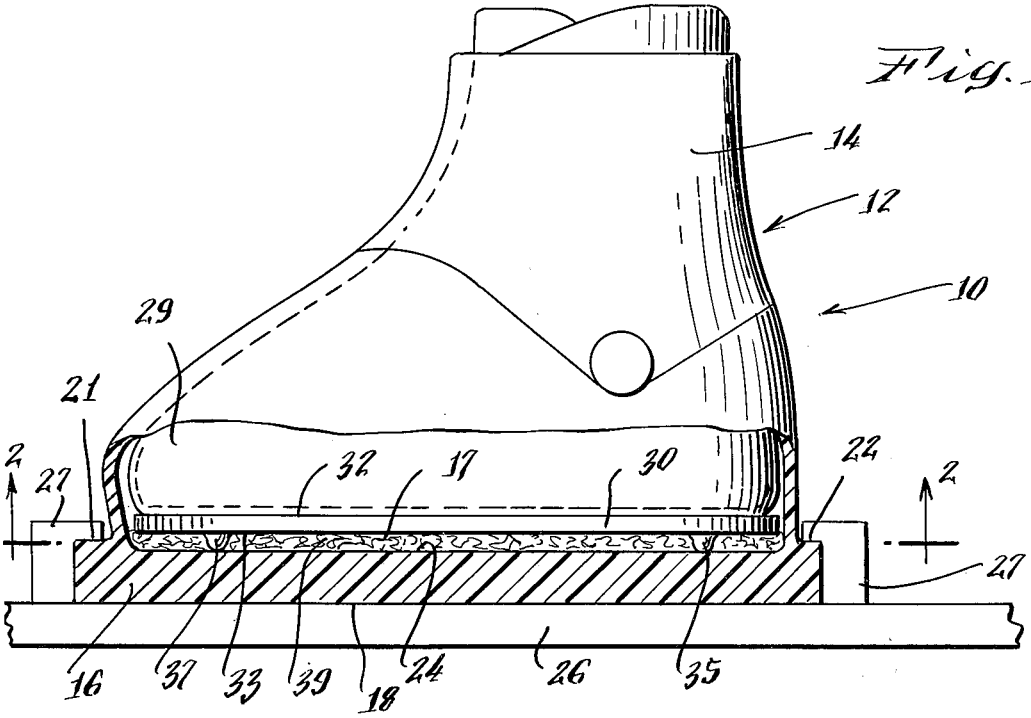
FIG. 1 is a side view of the ski boot according to the invention herein with the lower portion cut away.

As shown in FIG. 1, the outer boot 12 generally comprises an upper shell 14 which is substantially inflexible and secured to a boot sole 16. The boot sole 16 is substantially rectangular and of considerable thickness. The boot sole 16 has a top surface 17 and a bottom surface 18. As shown in FIG. 1, a small portion of the top surface 17 extends beyond each end of the upper shell 14 forming a front lip 21 and a rear lip 22. The remaining portion of the top surface 17 of the sole 16 which is disposed inside the upper shell 14 comprises the inside base 24 of the outer boot 12.

The outer boot 12 is fixed to a ski 26 by means of a pair of bindings 27 which are secured to the ski 26. When the outer boot 12 is in place on the ski 26, the bottom surface 18 of the sole 16 rests upon the ski 26, as shown in FIG. 1. The bindings 27 are selectively attached to the front lip 21 and the rear lip 22 of the outer boot 12 thereby holding the outer boot 12 to the ski 26 unless the bindings 27 are released. When the outer boot 12 is so in place, the outer boot 12 cannot move independently of the ski 26. An insulated inner boot 29 fits inside the upper shell 14 of the outer boot 12, and in the prior art the insulated boot 29 would rest upon the inside base 24 of the sole 16 and be immovable inside the outer boot 12. The insulated inner boot 29 of this invention, however, is laterally movable inside the upper shell 14 of the outer boot 12.

Figure 2:
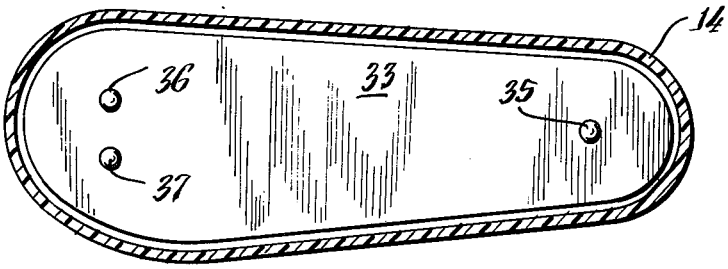
FIG. 2 is a sectional view of the ski boot taken along lines 2—2 of FIG. 1.

As shown in FIG. 1, an insert 30 is disposed in the outer boot 12 between the sole 16 and the inner insulated boot 29. The insert 30 is a plate-like portion and has an upper surface 32 and a lower surface 33. As shown in FIG. 2, the insert 30 is substantially foot shaped and has a single rear balance point 35 on its lower surface 33 near the heel. A right front balance point 36 and a left front balance point 37 are aligned with each other and disposed at one end of the lower surface 33 of the insert 30 opposite the rear balance point 35. The upper surface 32 of the insert 30 may be form fitted to an individual's foot. It may also be attached directly to the bottom of the inner boot 29.

Figure 3:
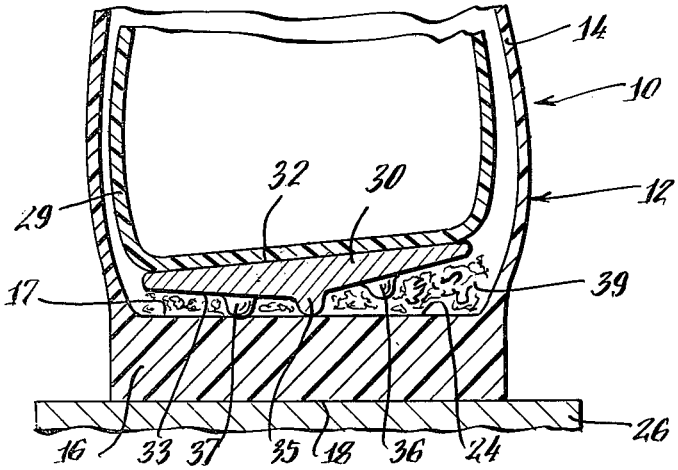
FIG. 3 is a cross-sectional view of the rear of the ski boot of FIG. 1.

The insert 30 tilts with respect to the outer boot 12, as shown in FIG. 3. When the insert 30 is in place in the outer boot 12, the balance points 35–37 rest upon the inside base 24 of the top surface 17 of the sole 16 of the outer boot 12, as shown in FIG. 1. The lower surface 33 of the insert 30 is not in contact with the inside base 24. The balance points 35–37 are disposed in such a manner that when weight is placed on and substantially evenly distributed over the upper surface 32 of the insert 30, the insert 30 remains in a level or horizontal position with respect to the outer boot 12 and the ski 26, as shown in FIG. 1. The insert 30 does not contact the sides of the upper shell 14 of the outer boot 12 and, therefore, if the weight on the upper surface 32 of the insert 30 is shifted to one side, as it would be with either inversion or eversion of the foot, the insert 30 will tilt in relation to the outer boot 12 and ski 26, as shown in FIG. 3. The weight shift can thereby be transmitted to the corresponding outer edge of the ski 26 causing the ski to turn without movement of the outer boot 12, and therefore, without lateral movement of the knees or the torso. This weight shift can be accomplished entirely by inversion or eversion of the skier's foot as it is inside the inner boot 29 resting upon the insert 30. As shown in FIG. 1, a compressible substance 39 is disposed between the lower surface 33 of the insert 30 and the sole 16 of the outer boot 12. The compressible substance 39 acts to aid the insert 30 in returning to its level or horizontal position after the insert has been tilted and the weight has once again become evenly distributed over its upper surface 32.

Figure 4:
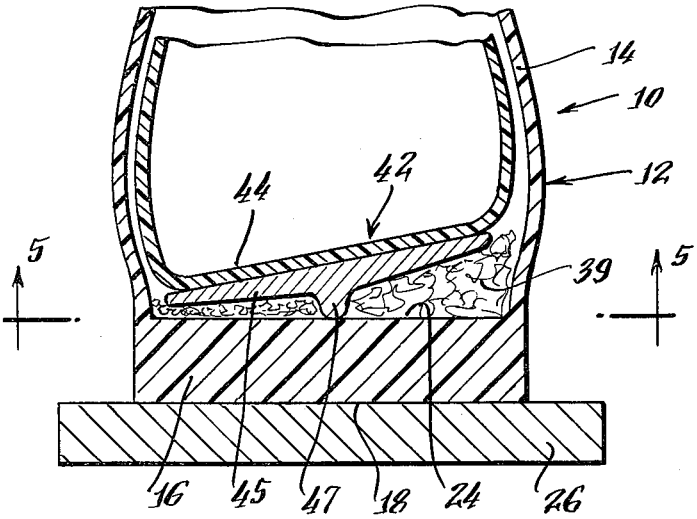
FIG. 4 is a cross-sectional rear view of the ski boot of FIG. 1 with a different insert.
Figure 5:
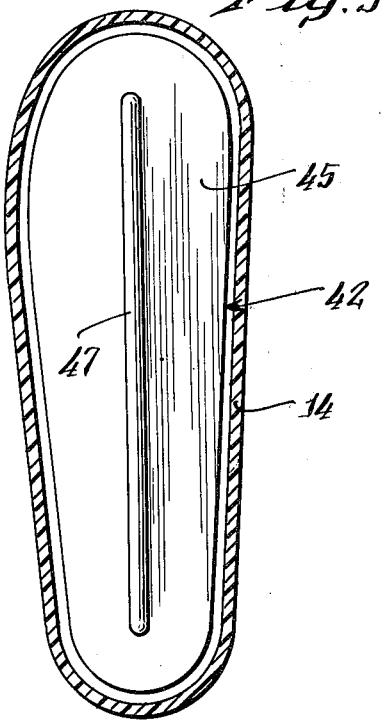
FIG. 5 is a sectional view of the ski boot taken along lines 5—5 of FIG. 4.

The insert of the first embodiment can be altered as shown in FIGS. 4–5. An insert 42 having an upper surface 44 and a lower surface 45 can be substantially foot shaped. The insert 42 has a substantially central ridge 47 longitudinally disposed on its lower surface 45, as shown in FIG. 5. When the insert 42 is disposed inside the outer boot 12, the ridge 47 rests upon the inside base 24 of the outer boot 12. As the sides of the insert 42 do not contact the upper shell 14 of the outer boot 12, the insert 42 will tilt with respect to the outer boot 12 and the ski 26 when the weight on the upper surface 44 shifts to one side, as shown in FIG. 4. The compressible substance 39 acts to restore the insert 42 to its original level position when the weight again becomes evenly distributed over the upper surface 44 of the insert 42.

Figure 6:
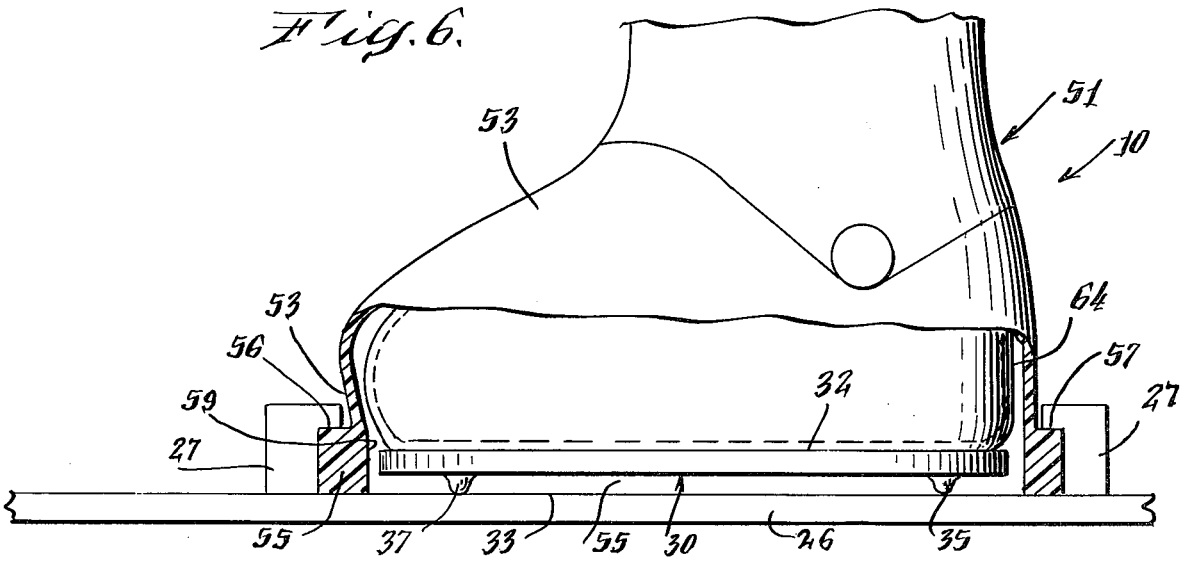
FIG. 6 is a side view of an altered ski boot with the lower portion cut away.

The outer boot of this first embodiment can be altered without affecting the invention. As shown in FIG. 6, an outer boot 51 comprises an upper shell 53 having a sidewall 55 disposed around and extending below the bottom of the shell 53. The sidewall 55 forms a front lip 56 and a rear lip 57 at opposite ends of the outer boot 51. The bindings 27 attach to the lips 56, 57 and secure the outer boot 51 to the ski 26.

The sidewall 55 of the outer boot 51 also defines a substantially rectangular sole opening 59. When the outer boot 51 is attached to the ski 26, the sole opening 59 is positioned adjacent to the top of the ski 26, as shown in FIG. 6 and extends from the ski 26 to the upper shell 53. The insert 30 is placed into the outer boot 51 and fits into the sole opening 59 so that the balance points 35–37 of the insert 30 rest upon the ski 26 itself. The lower surface 33 of the insert 30 is held away from the ski 26 by the balance points 35–37. As the insert 30 does not contact the sidewall 55, the insert 30 can tilt inside the sole opening 59. An insulated inner boot 64 fits inside the outer boot 51 and rests on the upper surface 32 of the insert 30. When the weight on the upper surface 32 is shifted by movement of the foot in the manner previously described, the insert 30 tilts with respect to the outer boot 51 and the ski 26 thereby transferring the weight shift to an outside edge of the ski 26 causing it to turn. The insert 42 shown in FIG. 5 having a centrally disposed ridge 47 can also be used in the boot 51 in place of the insert 30.

Figure 7:
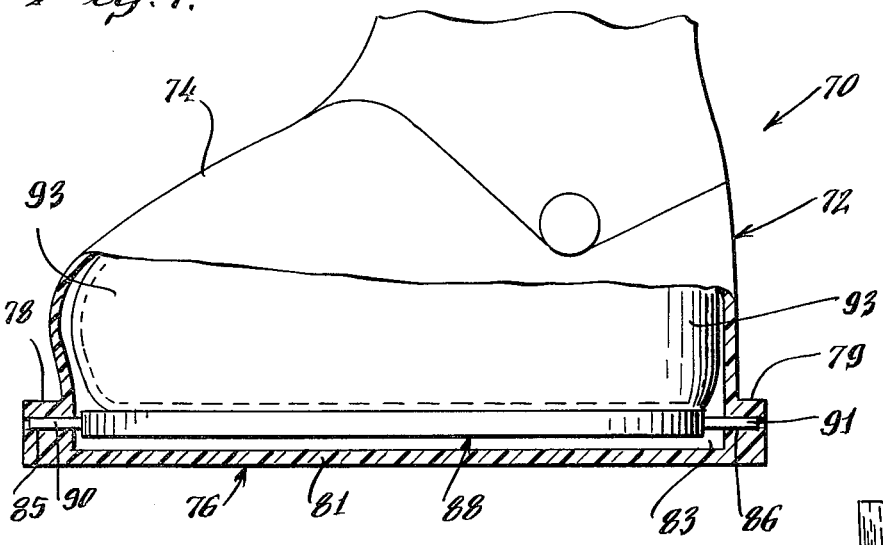
FIG. 7 is a side view of another ski boot according to the invention herein with the lower portion cut away.
Figure 8:
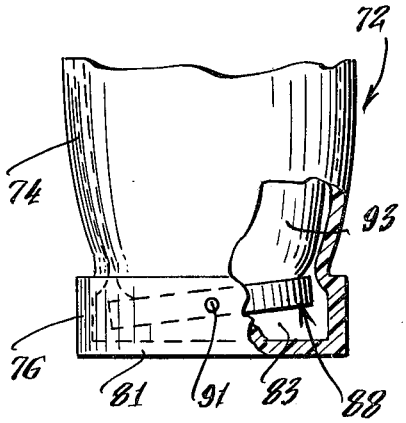
FIG. 8 is a rear view of the ski boot of FIG. 7 with a portion cut away.

Another ski boot 70 according to the invention herein is shown in FIGS. 7–8. As shown in FIG. 7, the ski boot 70 generally comprises an outer boot 72 having an upper shell 74 and a substantially rectangular sole 76 attached to the base of the shell 74. The sole 76 horizontally extends beyond the upper shell 74 at each end of the outer boot 72 forming a front lip 78 and a rear lip 79. The sole 76 of the outer boot 72 has a bottom 81 which extends the length of the outer boot 72 and contacts the ski when the outer boot 72 is in place. A rectangular compartment section 83 extends inside the outer boot 72 from the upper shell 74 to the bottom 81 of the sole 76. A front pivot hole 85 is longitudinally disposed in the sole 76 with respect to the outer boot 72 and substantially, centrally located under the front lip 78. A rear pivot hole 86 is longitudinally aligned with the front pivot hole 85 and substantially, centrally disposed under the rear lip 79, as shown in FIG. 7.

An insert plate 88 is rectangular and of slightly smaller dimensions than that of the compartment section 83. The insert plate 88 has a front pivot pin 90 aligned with or parallel to its longitudinal axis. The front pivot pin 90 extends from the insert plate 88 and aligns with and rotatably fits into the front pivot hole 85 when the plate 88 is in place. The insert plate 88 also has a rear pivot pin 91 which is longitudinally aligned with the front pivot pin 90 and which similarly fits into the rear pivot hole 86. When the insert plate 88 is so positioned, it is disposed some distance above the bottom 81 of the sole 76, as shown in FIG. 7, and can pivot about its longitudinal axis until further movement is obstructed by the bottom 81 of the sole 76, as shown in FIG. 8. An insulated inner boot 93 rests upon the top of the insert plate 88. With the inversion or eversion of the foot inside the inner boot 93, the insert plate 88 tilts as shown in FIG. 8 thereby transmitting the weight shift to the corresponding edge of the ski which causes it to turn. As with the previous embodiment the weight shift and the accompanying turning maneuver is accomplished only by a slight foot movement which causes the tilting of the insert which in this case is the insert plate 88, and without any bending of the outer boot 72 or lateral movement of the knees and twisting the torso. It is also possible to use this embodiment without the bottom 81 of the sole 76 of the outer boot 72. In this instance, the amount of pivoting of the insert plate would be limited by the ski itself when the boot was in place.

Another ski boot 100 according to the invention herein is shown in FIGS. 9–10. The ski boot 100 is generally comprised of the same outer boot 12 and sole 16 as the boot in FIGS. 1, 3 and 4. A flexible, substantially foot shaped insert 102 of this embodiment rests on the inside base 24 of the boot, as shown in FIG. 9. The flexible insert 102 is comprised of a large number of small cylindrical sections 104. The small cylindrical sections 104 are hollow and are arranged parallel and closely adjacent to each other. The cylindrical sections 104 are in an upright position when the insert 102 is properly in place upon the inside base 24 of the outer boot 12. The cylindrical sections 104 are flexible and will compress. Each cylindrical section 104 contains a compressible spring 105. The insert 102 is covered with a flexible material 106 which holds the springs 105 inside the cylinders 104 and also serves to hold the resilient cylinders 104 in place with respect to each other. When the insert 102 is in the outer boot 12, as shown in FIG. 9, the insulated inner boot 29 rests upon it, and the springs 105 and the cylinders 104 are essentially uncompressed. When the foot of the skier is in the insulated boot 29 and in a horizontal or neutral position, the insert 102 compresses substantially evenly as the weight is distributed nearly uniformly over each of the cylindrical sections 104 and springs 105 of the insert 102. However, when the weight is shifted to one side by eversion or inversion of the foot, the insert 102 becomes more compressed on the side which now carries the most weight, as shown in FIG. 10. Correspondingly, the opposite side of the insert 102 becomes virtually uncompressed. This weight shift will, as in the previous embodiments, be transmitted to the edge of the ski causing it to turn without a movement in the outer boot 12 or its upper shell 14.

Another ski boot 110 according to the invention herein is shown in FIGS. 11–12. This ski boot 110 is generally comprised of the same outer boot 12, upper shell 14, and sole 16 as shown in FIGS. 1, 3, 4, 9 and 10. A hydraulic insert 112 is used with this embodiment, and it has a substantially rectangular cross section, as shown in FIG. 11. The hydraulic insert 112 is substantially foot shaped and extends to cover most of the inside base 24 of the outer boot 12. The hydraulic insert 112 is comprised of a left compartment 114 and a right compartment 115 which are separated by a substantially, centrally disposed divider wall 118 which extends the length of the insert 112. The divider wall 118 has a fluid duct 119 in it which connects the left compartment 114 and the right compartment 115. The insert 112 has a left wall 124 and a right wall 125 of the same height as the divider wall 118. A left top plate 121 is hinged to the top of the divider wall 118, and the left top plate 121 covers the entire left compartment 114. The left top plate 121 extends to and contacts the left wall 124 and is vertically movable along that left wall 124. Similarly, a right top plate 122 is hinged at the top of the divider wall 118 and covers the right compartment 115. The right top plate 122 extends to and contacts the right wall 125. The right top plate 122 is vertically movable along the right wall 125. The insulated inner boot 29 rests upon the top plate 121, 122 of the hydraulic insert 112. The left wall 124 has a left extension 128 and the right wall 125 has a right extension 129 which bend slightly outwardly and act to position the inner boot 29 on the top plates 121, 122, as shown in FIG. 11.

The compartments 114, 115 contain fluid 116, and as shown in FIG. 11, when the weight is evenly distributed across the top plates 121, 122 the fluid level in each compartment is the same, and the top plates 121, 122 are both parallel to the inside base 24 of the outer boot 12 and the ski 26. When the foot of the skier inverts or everts inside the inner boot 29 the weight shifts, as shown in FIG. 12, the top plate bearing the disportionate amount of the weight moves towards the sole 16 of the outer boot 12 and the bottom of the insert 112. The volume of the compressed left compartment 114 is reduced and the fluid 116 is forced through the duct 119 thereby increasing the amount of the fluid 116 in the opposite right compartment 115. The increase in the amount of fluid 116 in this right compartment 115 raises the level of the right top plate 122. As shown in FIG. 12, when the right top plate 122 is forced upward by the fluid 116, the right top plate 122 substantially maintains its contact with the right extension 129, sealing the insert 112. The insert 112 can also be sealed by containing the fluid in a flexible pouch. If the weight is shifted in the opposite direction, the same sequence occurs with the fluid 116 being forced out of the right compartment 115 and into the left compartment 114. The left top plate 121 then contacts the left extension 128.

Another ski boot 130 according to the invention herein is shown in FIGS. 13–15. The ski boot 130 is generally comprised of the same outer boot 12, upper shell 14, and sole 16 as in the previous embodiment. As shown in FIG. 13, an insert sling 132 is disposed between the lower portion of the sides of the upper shell 14 of the outer boot 12. The insert sling 132 is attached to the inside of the upper shell 14 by means of fasteners 134. The insert sling 132 and the fasteners 134 extend for almost the entire length of the inner shell 14, as shown in FIG. 15.

The insert sling 132 is comprised of a somewhat flexible material and forms a cradle for the inner boot 29. The insert sling 132 is capable of supporting the weight of the skier, and when the weight of the skier is evenly distributed on the insert sling 132, the inner insulated boot 29 is suspended above the inside base 24 of the sole 16, as shown in FIG. 13. The insert sling 132 need not be a single piece, but could be of several separate strips of material. As shown in FIG. 14, when the skier's weight is shifted by inverting or everting his foot inside the inner boot 29, the insert sling 132 stretches to allow the inner boot 29 and the foot to tilt with respect to the outer boot 12 and the ski 26 thereby transferring the weight to the edge of the ski causing it to turn. As the insert sling 132 is comprised of somewhat flexible and resilient material, it also acts to return the insert sling 132 to a neutral position when the maneuver is complete and the weight has been shifted back so that it is once again evenly distributed.

With any of these embodiments certain changes can be made without departing from the spirit and scope of the invention. The inserts can be made removable or they can be integrated into and made part of a ski boot. If the inserts are removable, they can be inserted by themselves into existing ski boots without alteration of the existing equipment. It is also possible to use the inserts of this invention inside of the inner insulated boot without modification. The entire ski boot itself can also be altered so that it tilts with respect to the ski, which would, however, require an alteration in the present ski boot bindings. The insert can also be made part of the ski itself. In addition, the insert may operate upon pneumatic or piston principles.

Accordingly, the above description of the invention is to be construed as illustrative only rather than limiting. This invention is limited only by the scope of the following claims.

I claim:

1. A ski boot for holding a foot of a skier, said ski boot comprising an outer boot having a substantially inflexible upper shell, and support means disposed inside said outer boot near said ski in such a manner that said support means is laterally tiltable with respect to said ski and said outer boot upon inversion or eversion of said foot, and means for attaching said ski boot to a ski.

2. A ski boot as defined in claim 1 wherein said support means comprises an insert, said insert being disposed inside said outer boot near said ski in such a manner that said insert.

3. A ski boot as defined in claim 2 which includes an inner insulated boot adapted to receive a foot of the skier, said inner insulated boot fitting in and being laterally movable inside said outer boot.

4. A ski boot as defined in claim 3 wherein said inner insulated boot rests upon said insert.

5. A ski boot as defined in claim 3 wherein said insert is attached to the bottom of said inner insulated boot.

6. A ski boot as defined in claim 3 wherein said insert is disposed inside said inner insulated boot.

7. A ski boot as defined in claim 2 wherein said outer boot has a sole, said sole being substantially rectangular and having a top surface and a bottom surface, said sole being longitudinally aligned with and attached to the bottom of said upper shell, said insert resting upon that portion of said top surface of said sole inside said outer boot when said insert is in place.

8. A ski boot as defined in claim 7 wherein said insert is substantially foot shaped having an upper surface and a lower surface, said insert having a rear balance point disposed on said lower surface at one end and a pair of front balance points disposed on said lower surface opposite said rear balance point, all said balance points contacting said top surface of said sole when said insert is in place and not tilted.

9. A ski boot as defined in claim 7 wherein said insert is substantially foot shaped having an upper surface and a lower surface, said insert having a substantially central ridge longitudinally disposed on said lower surface, said ridge contacting said top surface of said sole when said insert is in place.

10. A ski boot as defined in claim 2 wherein said outer boot has a sole, said sole being substantially rectangular and longitudinally aligned with and attached to the bottom of said upper shell, said sole having a bottom, a compartment section extending inside said outer boot from said upper shell to said bottom.

11. A ski boot as defined in claim 10 wherein said insert is comprised of a substantially rectangular plate of smaller dimensions than said compartment section, said rectangular plate being pivotally supported inside said compartment section so that said rectangular plate can laterally tilt with respect to said ski.

12. A ski boot as defined in claim 2 wherein said insert is comprised of a series of compressible cylindrical sections, said cylindrical sections positioned adjacent to and longitudinally aligned with each other, each cylindrical section containing a compressible spring, said insert being covered with a flexible cloth and disposed inside said outer boot in such a manner that said cylindrical sections are vertically aligned with respect to said ski.

13. A ski boot as defined in claim 2 wherein said insert is comprised of a left compartment and a right compartment, said compartments containing a fluid, said compartments being longitudinally aligned and separated by a substantially centrally disposed dividing wall, said central dividing wall having at least one fluid duct which allows said fluid to pass between said compartments, said compartments having a pair of movable covers hinged at the top of said central dividing wall, said normally horizontal covers being tiltable and capable of reducing and increasing the volume of said compartments respectively thereby forcing fluid from out of one of said compartments and into the opposite compartment.

14. A ski boot as defined in claim 13 wherein said insert is disposed in said ski boot so that said foot of said skier rests upon said covers of said compartments and the inversion and eversion of said foot causing said covers to tilt.

15. A ski boot as defined in claim 7 wherein said insert is comprised of a flexible sling, said sling being attached to the inside of said upper shell of said upper boot so that said foot of said skier, when in said ski boot, rests inside said sling and is supported above said top surface of said sole by said sling when said insert is not tilted.

16. An insert for use with a ski boot having a sole, said insert comprising a foot supporting plate-like portion adapted to support a skier's entire foot, said plate-like portion being shaped so as to laterally tiltably fit inside the ski boot and rest upon and substantially cover the sole, and said plate-like portion having means arranged to permit lateral tilting of the foot with respect to the boot and the sole upon inversion or eversion when said plate-like portion is in place inside the boot, said insert having a rear balance point disposed on said lower surface at one end and a pair of front balance points disposed on said lower surface opposite said rear balance point, said front pair of balance points being non-longitudinally aligned.

17. An insert for use with a ski boot having a sole, said insert comprising a foot supporting plate-like portion adapted to support a skier's entire foot, said plate-like portion being shaped so as to laterally tiltably fit inside the ski boot and rest upon and substantially cover the sole, and said plate-like portion having means arranged to permit lateral tilting of the foot with respect to the boot and the sole upon inversion or eversion when said plate-like portion is in place inside the boot, wherein said insert is comprised of a series of compressible cylindrical sections, said cylindrical sections positioned adjacent to and longitudinally aligned with each other, each cylindrical section containing a compressible spring, said insert being covered with a flexible cloth and disposed inside said outer boot in such a manner that said cylindrical sections are vertically aligned.

* * * * *

UNITED STATES PATENT AND TRADEMARK OFFICE

CERTIFICATE OF CORRECTION

PATENT NO. : 4,074,446

DATED : February 21, 1978

INVENTOR(S) : Joel Howard Eisenberg

It is certified that error appears in the above-identified patent and that said Letters Patent are hereby corrected as shown below:

Column 7, line 6, delete "plate 121, 122" and substitute therefor --plates 121, 122--.

Column 8, lines 25-27 (claim 2, lines 2-4), delete ", said insert being disposed inside said outer boot near said ski in such a manner that said insert".

Column 10, line 11 (claim 16, line 9), delete "," (comma) and substitute therefor --;-- (semicolon).

Signed and Sealed this

*Sixth* Day of *June 1978*

[SEAL]

*Attest:*

RUTH C. MASON
*Attesting Officer*

DONALD W. BANNER
*Commissioner of Patents and Trademarks*